US005646911A

United States Patent [19]

Davis

[11] Patent Number: 5,646,911

[45] Date of Patent: Jul. 8, 1997

[54] TENNIS PACER

[76] Inventor: Douglas Jones Davis, 5235 90th St., Lubbock, Tex. 79424

[21] Appl. No.: 481,748

[22] Filed: Jun. 7, 1995

[51] Int. Cl.[6] ..... G04B 47/00; A63B 49/08

[52] U.S. Cl. ..... 368/10; 368/107; 473/463; 473/553

[58] Field of Search ..... 568/3, 10, 107–109, 568/113; 273/29 A, 73 R, 73 G, 73 J; 280/816, 819, 821

[56] References Cited

U.S. PATENT DOCUMENTS

| | | | |
|---|---|---|---|
| 4,111,444 | 9/1978 | Clemens, Jr. | 280/11.37 R |
| 4,731,766 | 3/1988 | Bunyea . | |
| 4,738,449 | 4/1988 | Droz . | |
| 4,930,810 | 6/1990 | Addison, Jr. . | |
| 4,971,320 | 11/1990 | Nesbit et al. . | |
| 5,357,487 | 10/1994 | Coleman, III . | |

FOREIGN PATENT DOCUMENTS

| | | |
|---|---|---|
| 2578074 | 2/1985 | France . |
| 2638671 | 3/1978 | Germany . |
| 3819667 | 12/1989 | Germany . |
| 4007549 | 9/1991 | Germany . |

*Primary Examiner*—Vit W. Miska
*Attorney, Agent, or Firm*—Novak Druce Reynolds Burt

[57] ABSTRACT

A pacing device for a tennis player. The pacer includes a housing within which at least a portion of the pacer is enclosed. The housing is suitable for incorporation into a tennis racket. A read-out is located at an exterior of the housing for displaying information. A timer is positioned within the housing and in communication with the read-out for displaying information generated by the timer. An input device allows a player to program the timer to track a single or variable elapsed period of time.

14 Claims, 2 Drawing Sheets

TENNIS PACER

FIELD OF THE INVENTION

The present invention relates generally to accessories for tennis rackets. More particularly, it relates to a pacing device for a tennis player incorporatable into the body of a tennis racket.

BACKGROUND OF THE INVENTION

Tennis being the popular sport that it is, players are constantly seeking new ways to improve their game. Equipment used in tennis includes an assortment of tennis balls and a tennis racket, among others. Accessory devices have been positioned on and within tennis rackets to enhance the enjoyment of the game. Several patents have issued concerning such devices.

U.S. Pat. No. 4,938,349 to Nesbit et al. for a Tennis Racket Equipped With A Portable Radio includes disclosure of a portable radio incorporated into the throat and handle of a tennis racket. German patent number 3,819,667 to Pappers for a Tennis Racket With Electronic-Scoring Device In Handle - Operated Via Switch By User's Thumb And Displaying Both User's and Opponent's Score includes disclosure of a tennis racket with a counter and a display in the racket's handle. German patent number 4,007,549 to Pappers for a Tennis Racket Incorporating Electronic Counter and Display—Contained In Hollow Space Provided in Racket Handle includes disclosure of a tennis racket handle having a hollow space therein that houses an electronic tennis stroke counter. The counter is connected to a display that is attached to the exterior of the handle. None of these patents, however, address the need for a timing device incorporated into a tennis racket that marks specific amounts of time that correspond to periods prescribed by the rules of the game. As an example, the official rules under which a match is being played may require that a player serve within a specific amount of time. If the player does not serve in that amount of time, he or she may be penalized. It is possible that there may be one or more such periods of time with which a player will want to become accustomed to playing within. In any event, during practice a player can benefit from having the time periods marked so that he or she is conditioned to automatically execute the required activities without being penalized. Because the player will wish to focus his or her concentration on playing the game effectively, and not watching a clock, it would be beneficial to have an audible, as well as visual indication of the amount of time that has passed and when the prescribed period has expired.

SUMMARY OF THE INVENTION

The present invention is in response to recognition of the need for a device that will mark specific time periods for a tennis player as described above. The invention is referred to as a pacer because it assists the player in pacing his natural game to coincide with the rules. Because the player will want to individually control the functions of the pacer, it is most advantageous for the pacer to be located in or on the player's tennis racket.

The rules may specify one or more periods of time of which the player will want to be cognizant. The periods may be of differing durations, and they may begin to be marked at similar or different times. As a result, one embodiment of the present invention permits two or more periods of time to be independently marked and tracked. It may be that the periods will be simultaneously marked and run concurrently, or they may begin at different times and run independently. In any event, the player will want to have ready access to information concerning where in the running period he or she is, and also be informed when the period has expired. As an option, the pacer may also give warnings concerning the pendency of the period's expiration. For these reasons, it is contemplated that a visual display will be provided that shows the progress through the time period and an audible alarm will be provided to note warnings and expirations. In the case of a pacer having the capability of marking two or more time periods, it is anticipated that two or more input means will be supplied, one for each period to be tracked. In a preferred embodiment, the input means are buttons. Alternatively, one button may be supplied and sequences of the button's engagement will control the pacer.

It is desirable to have the pacer includable in the manufacture of new tennis rackets, as well as be easily added to existing rackets. In a preferred embodiment, the pacer will be recessed into a portion of the racket's handle. The pacer is recessed because it will be protected when it is housed in the body of the tennis racket. Recession also prevents the pacer from being a protrusion off of the racket that may interfere with the player's activity or provide a projection that can snag on other items. Accordingly, FIG. 1 shows a pacer fully recessed into the butt-end of the tennis racket handle and protected therein. Because a recess is required for this embodiment of the pacer, this configuration will most likely be included in rackets during original manufacture. FIG. 2 shows a pacer recessed into a butt-cap for a racket handle. The cap provides a means by which the pacer can be recessed and applied to existing rackets.

FIGS. 3 and 4 illustrate an embodiment of the pacer in which it is attached to the exterior of an existing tennis racket handle. While the pacer is not recessed into the handle, it provides the benefit of being easily included upon a player's existing racket. The pacer may be attached by any suitable means. It may be releasably coupled to the racket by such means as Velcro or snaps, or it may be more permanently attached to the tennis racket handle by such means a rubber cement and the like. While the pacer has been described thus far as being incorporatable into a tennis racket handle, and in particularly the bottom end or butt-end of the handle, it is also contemplated that the pacer may in included at other locations upon the racket. Furthermore, the pacer disclosed herein is applicable to other racket games having specific time periods associated therewith. Therefore, the present invention may be utilized in other racket based games such as badminton and racket ball.

In one particular embodiment of the present invention, the pacer includes a read-out, timer, and input device. The pacer allows a player to program the desired period of time, or times, to be tracked. The read-out indicates the elapsed amount of time.

In another embodiment, the pacer includes two buttons. Each button is configured differently from the other in a physical sense. The different configuration allows the player to control the pacer exclusively by touch, without having to look at the pacer. It is contemplated that the buttons may be dissimilarly sized and/or shaped, or they may extend at different lengths off of the racket. In one specific embodiment, one button tracks a sixty second time period while the other button tracks a twenty second time period. An alarm can be included to indicate that the time period has expired. While the time periods are fixed in this described embodiment, it is contemplated that one or both may be user variable to make the pacer more versatile.

The pacer includes a housing within which at least a portion of the pacer is enclosed. The housing is suitable for incorporation into a tennis racket. A read-out is located at an exterior of the housing for displaying information. A timer is positioned within the housing and in communication with the read-out for displaying information generated by the timer. An input device allows a player to program the timer to track the desired period of time. As explained, the input device will typically be a depressible button. Alternatively, the input device may be a knob controlling a rheostat through which the time period is variable through a range.

In another embodiment, the housing is suitable for incorporation into the handle of a tennis racket. The housing is recessed into a butt-end of the handle of the racket.

In an additional embodiment of the pacer for a tennis player, the pacer includes a housing within which at least a portion of the pacer is enclosed. The housing is suitable for being coupled to a tennis racket. A read-out is located at an exterior of the housing for displaying information. A timer is positioned within the housing and in communication with the read-out for displaying information generated by the timer. An input device allows a player to program the timer to track an elapsed period of time.

Another embodiment of the present invention is a method of providing a pacer for a tennis player. The method includes the steps of providing a tennis racket with a handle and incorporating a pacer into the bottom of the handle wherein the pacer has a read-out, a timer, and an input device.

A further embodiment of the invention is a method for providing a pacer to a tennis player. The pacer can be incorporated into a tennis racket, preferably in the handle.

In summary, the present invention's purpose it to provide a pacing device to a player of a racket sport that is convenient and unobtrusive.

DETAILED DESCRIPTION OF THE PREFERRED EMBODIMENTS

Figure 1:
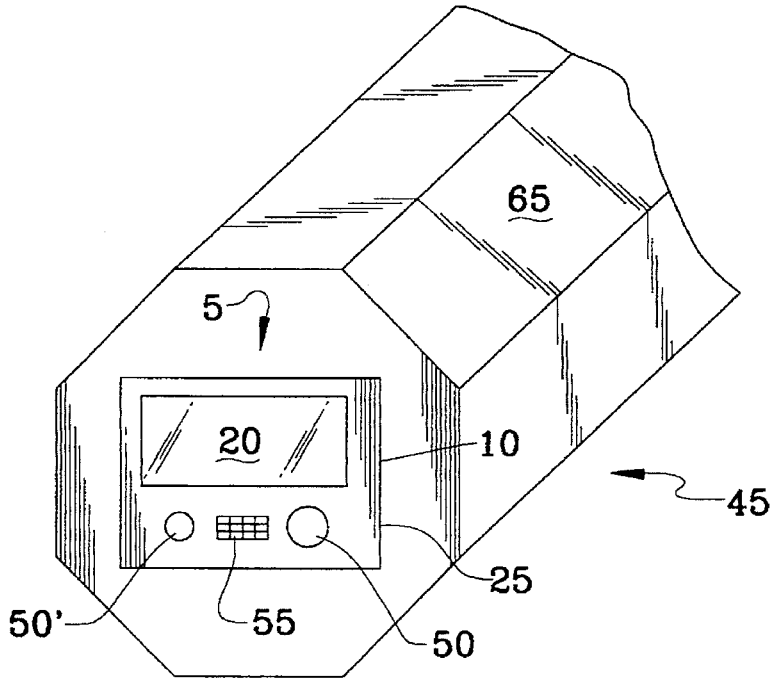
FIG. 1 is a perspective view of the pacer recessed into the butt-end of a tennis racket handle.

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefor, specific structural and functional details disclosed herein are not to be interpreted as limiting, but merely as a basis for the claims and as a representative basis for teaching one skilled in the art to variously employ the present invention.

Certain terminology will be used in the following description for convenience and reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure being referred to. This terminology will include these words, specifically mentioned derivatives thereof, and words of similar import.

Furthermore, in the claims the elements have been recited as being "coupled"; the reason for such terminology being that it is anticipated that elements may be connected together in such a way that there are other components interstitially located between the connected elements or that the elements may be connected in fixed or movable relation one to the other.

Figure 3:
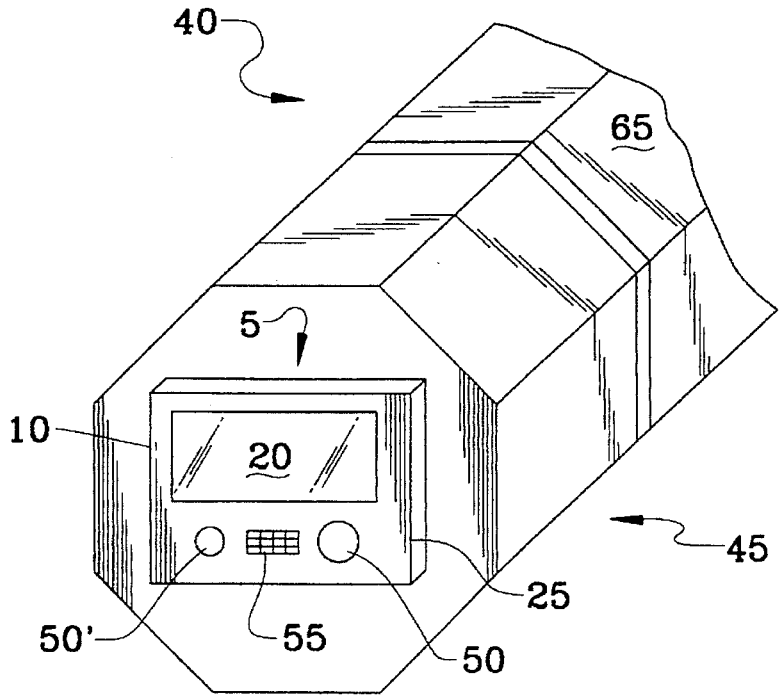
FIG. 3 is a perspective view of the pacer mounted to an exterior surface of the butt-end of a tennis racket handle.
Figure 2:
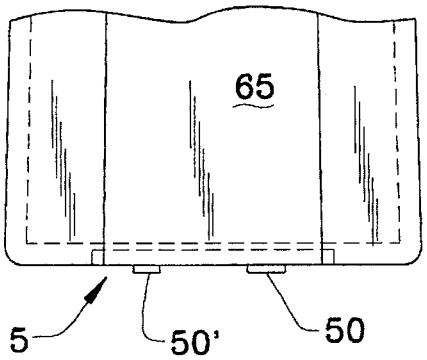
FIG. 2 is a side view of a pacer incorporated into a cap for the butt-end of a tennis racket suitable for installation upon existing racket handles.
Figure 4:
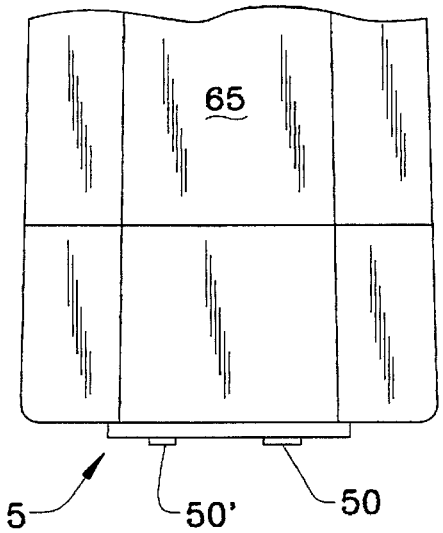
FIG. 4 is a side view of a capped tennis racket handle that has been retro-fitted with a pacer that is connected to an exterior surface of the butt-end of a tennis racket handle.

Referring to the Figures, a tennis pacer 5 is displayed. In the embodiments of FIGS. 1 and 2, the pacer 5 is incorporated into the bottom or butt-end 45 of a handle 65 of a racket 40. It should be understood, however, that the pacer 5 can be attached anywhere on the racket 40. As described hereinabove, the buttons are shown in FIGS. 1 and 3 as being of two different sizes.

The pacer 5 includes a housing 10, a read-out 20, a timer 30 and at least one input device 35. The housing 10 contains at least a portion of the pacer 5. In FIGS. 1 an 2, the housing 10 is recessed into a butt-cap 6 of the racket 40 thereby providing shielding protection to the pacer 5. The read-out 20 is displayed on an exterior 25 of the housing 20. In one embodiment, it is contemplated that the read-out 20 shall be displayed on an LED display. In the illustrated embodiment of the present invention, the input device 35 includes two buttons; a first button 50 and a second button 50'. The larger first button 50 is for a sixty second timing mode. The smaller second button 50' is for a twenty second timing mode. In a further embodiment, these buttons can be used to program the pacer 5 to track any period of time that is desired. An audible alarm 55 is provided and connected to the timer 30 of the pacer 5 so that as the prescribed time expires, the alarm 55 sounds to notify the player.

Figure 5:
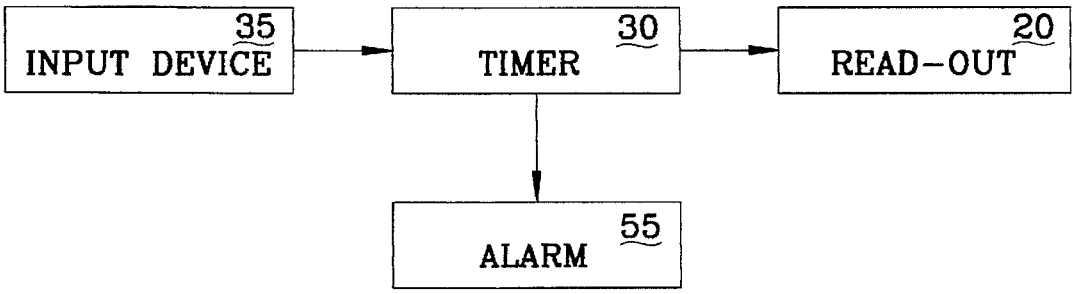
FIG. 5 is a schematic diagram of the circuitry used in one embodiment of the tennis pacer.

As shown in FIG. 5, standard circuitry is utilized to connect the various components to one another; that is, the input device 35 which in this embodiment is input buttons 50 are in communication with the timer 30 to actuate the same. The timer 30, in turn, is in communication with the read-out 20 so that information generated by the timer 30 may be displayed at the read-out 20. Similarly, the timer 30 is also communicatingly connected to the alarm 55 to give off audible notice of the timer's 30 status. A power supply is also required that is integrally incorporated into the pacer 5.

The preferred method of providing the pacer 5 for a tennis player incorporates the pacer 5 into the bottom (butt-end) 45 of the handle 65 of the tennis racket 40. Construction of the pacer 5 will be predominantly from plastic to minimize both cost and weight, while providing adequate strength and durability.

It is to be understood that while certain forms of the present invention have been illustrated and described herein, it is not to be limited to the specific forms or arrangement of parts described and shown.

What is claimed and desired to be secured by Letters Patent is as follows:

1. A pacer for a tennis player; said pacer comprising:

a housing within which at least a portion of said pacer is enclosed, said housing being suitable for incorporation into a tennis racket;

a read-out located at an exterior of said housing for displaying information;

a timer positioned within said housing and in communication with said read-out for displaying information generated by said timer; and at least one input device through which a player can program said timer to track an elapsed period of time.

2. The pacer for a tennis player of claim 1, wherein said housing is adapted for incorporation into a handle of a tennis racket.

3. The pacer for a tennis player of claim 1, wherein said housing is recessed into a butt-end of a handle of a tennis racket.

4. The pacer for a tennis player of claim 1, wherein said timer is adjustable to track variable lengths of time based on input through the input device.

5. The pacer for a tennis player of claim 1, wherein said input device comprises two actuating buttons.

6. The pacer for a tennis player of claim 1, wherein said pacer further comprises an audible alarm controlled by said timer.

7. The pacer for a tennis player of claim 5, wherein said two actuating buttons are differently shaped and each button controls a different period of time to be tracked by said pacer.

8. The pacer for a tennis player of claim 5, wherein said two actuating buttons are differently sized and each button controls a different period of time to be tracked by said pacer.

9. A pacer for a tennis player; said pacer comprising:

a housing within which at least a portion of said pacer is enclosed, said housing being suitable for being coupled with a tennis racket;

a read-out located at an exterior of said housing for displaying information;

a timer positioned within said housing and in communication with said read-out for displaying information generated by said timer; and an input device through which a player can program said timer to track an elapsed period of time.

10. The pacer for a tennis player of claim 9, wherein said housing is adapted to be coupled to a handle of a tennis racket.

11. The pacer for a tennis player of claim 9, wherein said housing is adapted to be coupled to a bottom of a handle of a tennis racket.

12. The pacer for a tennis player of claim 9, wherein said input device further comprises at least one depressible button for actuating the timer.

13. The pacer for a tennis player of claim 9, wherein said input device further comprises two actuating buttons for initiating two different periods of time to be tracked.

14. The method of providing a pacer for a tennis player, comprising the steps of:

providing a tennis racket with a handle; and incorporating a pacer into the butt-end of the handle wherein said pacer includes a read-out, a timer, and an input device for controlling the timer.

* * * * *